US009423163B2

(12) United States Patent
Walls et al.

(10) Patent No.: US 9,423,163 B2
(45) Date of Patent: Aug. 23, 2016

(54) MODULAR THERMOELECTRIC SUBMERGED HIGH VOLUME LIQUID TEMPERATURE CONTROLLING SYSTEM

(71) Applicant: BREWJACKET, INC., Ithaca, NY (US)

(72) Inventors: Aaron Walls, Ithaca, NY (US); Matthew Goff, Ithaca, NY (US); Evgeniy Tkachenko, Sugar Land, TX (US)

(73) Assignee: BREWJACKET INCORPORATED, Boulder, CO (US)

( * ) Notice: Subject to any disclaimer, the term of this patent is extended or adjusted under 35 U.S.C. 154(b) by 120 days.

(21) Appl. No.: 14/315,828

(22) Filed: Jun. 26, 2014

(65) Prior Publication Data

US 2015/0013347 A1 Jan. 15, 2015

Related U.S. Application Data

(60) Provisional application No. 61/839,806, filed on Jun. 26, 2013.

(51) Int. Cl.

| | |
|---|---|
| ***F25B 21/02*** | (2006.01) |
| ***F25B 21/04*** | (2006.01) |
| ***F25D 31/00*** | (2006.01) |

(52) U.S. Cl.

CPC ..... *F25B 21/04* (2013.01); *F25D 31/003* (2013.01); *F25B 2321/021* (2013.01)

(58) Field of Classification Search

CPC ..... F25B 21/02; F25B 21/04; F25B 2321/02; F25B 2321/021; F25B 2321/0211; F25B 2321/0212; F25D 31/002; F25D 31/003; F25D 31/005

See application file for complete search history.

(56) References Cited

U.S. PATENT DOCUMENTS

| | | | | |
|---|---|---|---|---|
| 6,103,280 | A * | 8/2000 | Molzahn | A23G 9/00 426/109 |
| 6,370,884 | B1 * | 4/2002 | Kelada | B67D 1/0869 62/3.3 |
| 2007/0051125 | A1 * | 3/2007 | Chiusolo | B67D 1/0857 62/393 |
| 2009/0049845 | A1 * | 2/2009 | McStravick | F25B 21/02 62/3.62 |
| 2014/0352329 | A1 * | 12/2014 | Bloedow | F25B 21/02 62/3.6 |

* cited by examiner

*Primary Examiner* — Daniel Rohrhoff

(74) *Attorney, Agent, or Firm* — William Greener; Frederick J. M. Price; Bond, Schoeneck & King, PLLC

(57) ABSTRACT

The present invention relates to a liquid temperature controlling system and, more particularly, to a modular liquid temperature controlling system that is structured and/or configured to cool a volume of liquid stored in a container through direct contact with a portion of the system which utilizes at least one thermoelectric device.

6 Claims, 8 Drawing Sheets

MODULAR THERMOELECTRIC SUBMERGED HIGH VOLUME LIQUID TEMPERATURE CONTROLLING SYSTEM

RELATED APPLICATION DATA

The present application claims priority to and the benefit of U.S. provisional patent application No. 61/839,806, filed Jun. 26, 2013, and is hereby incorporated by reference in its entirety.

BACKGROUND OF THE INVENTION

1. Field of the Invention

The present invention relates to a liquid temperature controlling system and, more particularly, to a modular liquid temperature controlling system that is structured and/or configured to cool and/or heat a volume of liquid stored in a container through direct contact with a portion of the system which utilizes at least one thermoelectric device.

2. Description of the Related Art

Conventional liquid temperature control systems, such as a kegerator, indirectly cool or heat liquids by controlling the temperature of the air in an enclosed space. In this set-up, the air is cooled or heated first, then the container of liquid is cooled or heated, and then the liquid is cooled or heated.

Description of the Related Art Section Disclaimer: To the extent that specific patents/publications/products are discussed above in this Description of the Related Art Section or elsewhere in this Application, these discussions should not be taken as an admission that the discussed patents/publications/products are prior art for patent law purposes. For example, some or all of the discussed patents/publications/products may not be sufficiently early in time, may not reflect subject matter developed early enough in time and/or may not be sufficiently enabling so as to amount to prior art for patent law purposes. To the extent that specific patents/publications/products are discussed above in this Description of the Related Art Section and/or throughout the application, the descriptions/disclosures of which are all hereby incorporated by reference into this document in their respective entirety(ies).

SUMMARY OF THE INVENTION

Various embodiments of the present invention may be advantageous in that they may solve or reduce one or more of the potential problems and/or disadvantages discussed above.

Various embodiments of the present invention may exhibit one or more of the following objects, features and/or advantages:

It is a principal object and advantage of the present invention to provide a liquid temperature controlling system that directly cools and/or heats liquid (i.e., by directly contacting the liquid) stored in a container (e.g., keg, growler etc.). Cooling and/or heating the liquid directly includes one or more of the following advantages over conventional liquid cooling/heating systems: it is faster, takes less power, takes up less space, has less of a footprint, doesn't require large retrofits to the structure (no need to add a cooling room or make space for a fridge—if you have space for a keg you have enough space).

In accordance with the foregoing objects and advantages, an embodiment of the present invention is directed a liquid temperature controlling system including one or more of the following: a thermal shielding case that surrounds a liquid container, a rod or rods or heatpipe or heatpipes structured and/or configured to be submerged in the container of liquid, a cooling plate attached to the rod, at least one peltier/thermodynamic chip attached to the cooling plate, a heat sink attached to the chip, a fan attached to the heat sink, a thermal sensor/temperature detection probe, and an electronic control device attached to the thermal sensor/temperature detection probe and collectively structured/configured to detect the temperature of the liquid and to control the temperature of the liquid in the system.

In accordance with an alternative embodiment of the present invention, a liquid temperature controlling system including one or more of the following is provided: a thermal shielding case that surrounds a liquid container, two cooling plates, more than one peltier/thermodynamic chip, more than one heat sink, more than one fan, an electronic control device, and a thermal sensor/temperature detection probe. The plurality of peltier/thermodynamic chips can be mounted to the top of the container (e.g., keg) which is preferably made out of a metal. The peltier/thermodynamic chips are structured and/or configured to cool the contents of the entire vessel through the metal installation (e.g., tap of a keg) on which they are attached (in a similar manner as discussed with respect to the first embodiment referenced above).

The details of one or more embodiments are described below and in the accompanying drawings. Other objects and advantages of the present invention will in part be obvious, and in part appear hereinafter.

BRIEF DESCRIPTION OF THE DRAWINGS

The present invention will be more fully understood and appreciated by reading the following Detailed Description in conjunction with the accompanying drawings, in which.

DETAILED DESCRIPTION

Figures 1A, 1B:
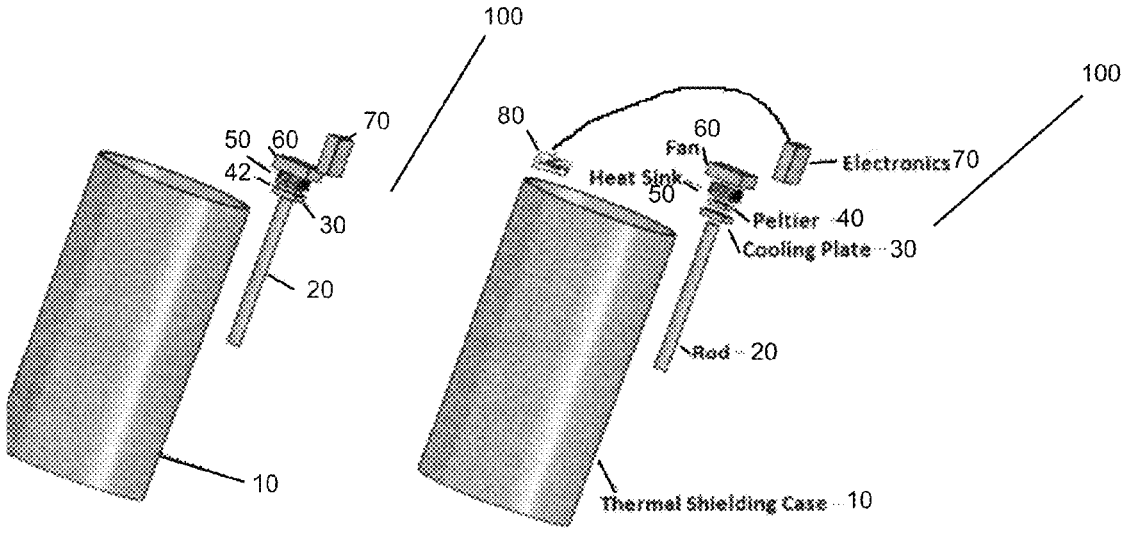
FIG. 1A-1B are assembled and exploded schematic representations, respectively, of a liquid temperature controlling system in accordance with an embodiment of the present invention.

The present invention will be more fully understood and appreciated by reading the following Detailed Description in conjunction with the accompanying drawings, wherein like reference numerals refer to like components.

The liquid temperature controlling system of an embodiment of the present invention is structured and or configured to cool a volume of liquid stored in a container through direct contact of the liquid by a portion of the liquid temperature controlling system. For example, as shown in FIG. 1*a-b*, schematic representations of a liquid temperature controlling system 100 are shown (1*a*—liquid temperature controlling system 100 with its component parts connected; 1*b*—liquid temperature controlling system 100 with its component parts in a semi-exploded view). FIG. 1*a-b* also shows a thermal shielding case 10 that surrounds a liquid container (not shown). Liquid temperature controlling system 100 includes, but is not limited to a rod (or rods) 20, a cooling plate 30, at least one peltier/thermodynamic chip 40, a heat sink 50, a fan 60, electronics 70, and a thermal sensor/temperature detection probe 80. The use of more than one of each of these components is contemplated. Some or all of the components of the liquid temperature controlling system can be enclosed (partially or otherwise) is a case preferably made of a plastic (not shown). It is preferable that the rod is not so enclosed.

"Peltier" describes the effect or process by which the thermoelectric chips work. As should be understood by those of skill in the art, the peltier effect is achieved by running a current through multiple thermoelectric couples (a "couple" is two types of metal that meet, causing a temperature gradient). When a current is run through the couples, one side of the chip cools and the other heats.

Figure 4A:
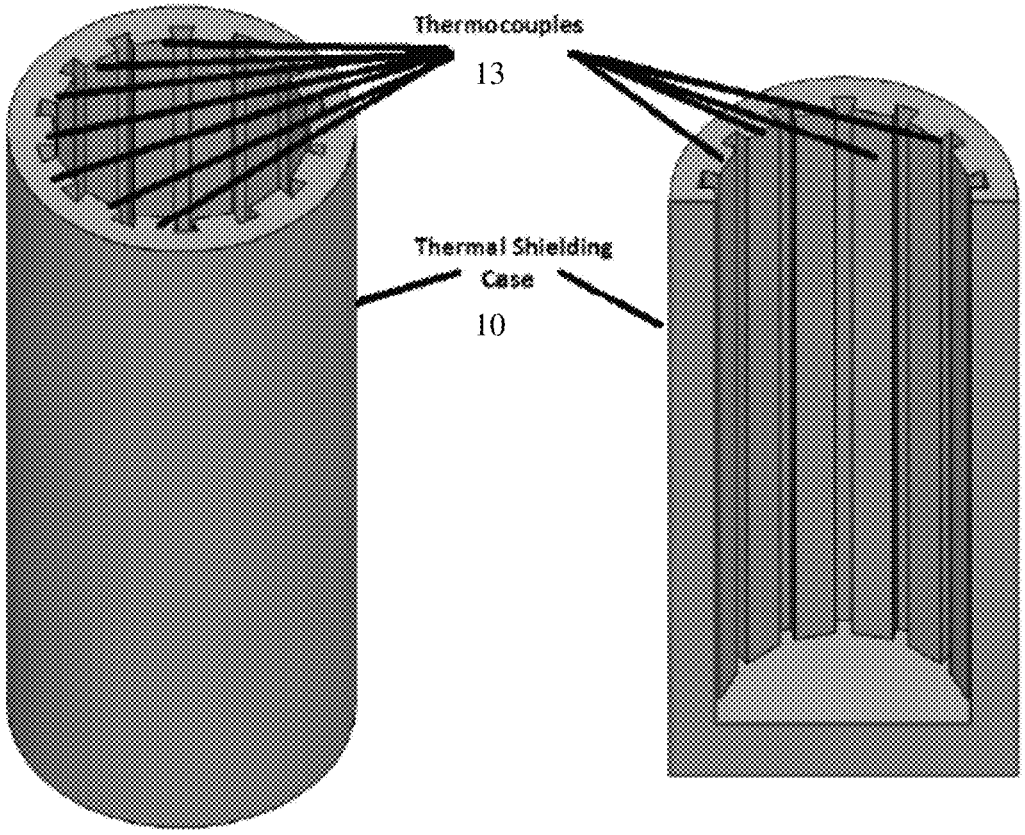
FIG. 4*a-b* are schematic representations of a liquid temperature controlling system in accordance with an alternative embodiment of the present invention.
Figure 4B:
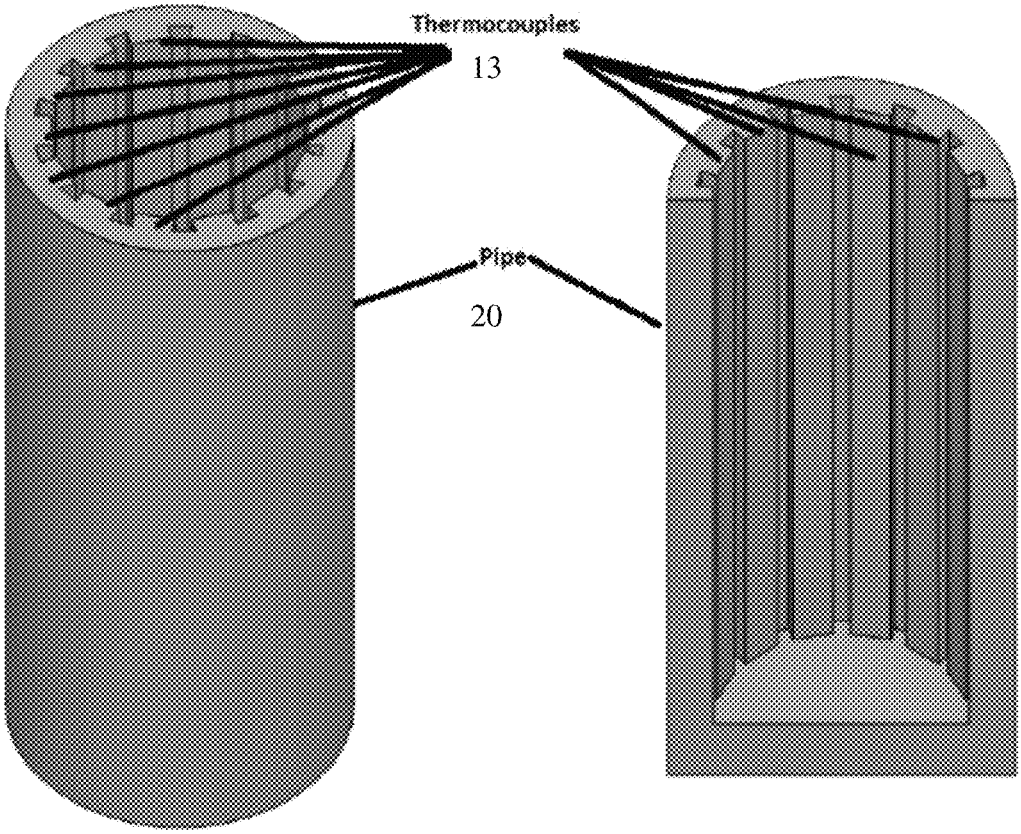

In accordance with an embodiment of the present invention, the cooling effect obtained from the "cold" side of the peltier chip or the heating effect obtained by reversing the current through the peltier chip 40 is distributed through the liquid by way of a submerged metal (e.g., stainless steel, plated aluminum, aluminum, steel, copper, nickel, titanium, and iron; these materials may also be treated with electroless plating and/or hard anodizing) rod or rods or heatpipe or heatpipes 20 (which are connected (directly or indirectly through a cooling plate 30 to the peltier chip 40). The "hot" side of the peltier chip or "cold" side of the peltier chip if the current is reversed 40 is preferably connected (directly or indirectly) to heat sink 50 which dissipates heat or cold away from the liquid temperature controlling system 100. Currently, the peltier effect is used to cool processors in computers to prevent them from overheating. Embodiments of the present invention take advantage of the cooling and heating properties of the peltier effect by mounting the thermoelectric/peltier chip(s) 40 on stainless steel (or aluminum or other metal) rod(s) or heatpipe(s) 20 and submerging them in the liquid (or on top of a container, as will be discussed with reference to FIG. 2*a-b*). It is contemplated that an embodiment of the present invention will not use peltier chips, and will instead use custom thermoelectric devices that use the peltier effect. For example, the inside of a thermal shielding case 10, hollow pipe, or rod 20 could be lined with thermocouples 13 (see FIG. 4*a-b*), with the cooling side facing out and hot side facing in, to dissipate the heat.

The liquid is cooled via the submerged rod(s) or heatpipe(s) 20 through conduction-driven convection. The rod(s) or heatpipe(s) 20 (or other contemplated apparatuses) that are submerged in the liquid have a temperature gradient, so they will directly affect the temperature through conduction. Since heat rises, the hotter portions of the liquid will rise and the colder parts will fall. Movement leads to convection; movement over a colder surface gives a higher rate of change of the temperature. The movement of the liquid is driving an increased rate of change of the temperature. This is why submersion is preferable, and makes this embodiment of the present invention unique.

The submerged rod(s) or heatpipe(s) 20 can be anodized, which protects them against acidic corrosion and makes the liquid safe for consumption. Certain types of metal are preferable if the liquid is going to be ingested. Anodized metal prevents corrosion, increases durability, and prevents rusting and flaking. The rods could also be made with stainless steel, titanium, a few different types of aluminum, copper (if cooling nonacidic liquids), and other metals; some should be treated and some need not be. The present invention contemplates the potential use of all types of metal that would leave contacted liquid safe for ingestion, whether treated or not.

The chip 40 can be directly attached to a cooling plate 30 by, e.g., using thermal paste. The plate can be attached to the stainless steel rods by a screw or other like mechanism. Thermal paste or another thermal adhesive or various other rubbery substances could be used to attach the plate to the rods, and the use of all such substances is hereby contemplated.

Temperature control: a thermal sensor 80 can be submerged along with the rod 20 in the liquid. The temperature readings from the thermal probe are read into an electronic controller 70 which can automatically modulate the amount of heat that is transferred using the peltier thermoelectric effect per a control/communication connection (wired or wireless) to the thermodynamic peltier chip. The electronic controller 70 can be controlled by and can communicate with a user's computer (not shown) connected to the electronic controller 70, either directly through a hard line connection or wirelessly. The user's computer can include any type of computer device, e.g., desktop, laptop, smart phone 310, cell phone, computer tablet, and/or other portable computer like device. Any wireless transmission discussed herein can be accomplished through any wireless protocol/technology, including, but not limited to, ZigBee standards-based protocol, Bluetooth technology, and/or Wi-Fi technology. The wireless transmission can be over a network which can be any suitable wired or wireless network capable of transmitting communication, including but not limited to a telephone network, Internet, Intranet, local area network, Ethernet, online communication, offline communications, wireless communications and/or communications means. Electronic controller 70 can be programmed/tuned. There can be custom tuning settings, meaning that the tuning can be controlled and custom-set during assembly. It is also possible that users/customers can be allowed to choose custom temperature settings, the timing when certain temperature settings go into effect, and/or control the temperature themselves per there computing device through the downloading of software, application, or running software stored at some remote location; not in the user's device.

As noted above, one or more heat sinks 50 can be used to dissipate the excess heat from the hot side of the peltier chip(s) 40. Each heat sink 50 can have two parts. The first part is a fin or other structure that functions to conduct the unwanted temperature away from the device. It spreads the heat as far away as possible. The other part is a fan 60 or similar device that helps to pull the unwanted heat away faster. It rapidly cools the thermoelectric chip 40 by increasing the surface area affected.

Finally, the container of liquid can be wrapped with aerogel or another type of insulation (thermal shielding case 10) that keeps heat transfer for occurring anywhere other than where the device forces it to occur. The insulated "jacket" should fit snugly around the container of liquid (e.g., bucket or keg).

The liquid temperature controlling system 100 can be powered by a power plug, battery, or solar energy.

Figures 3A, 3B:
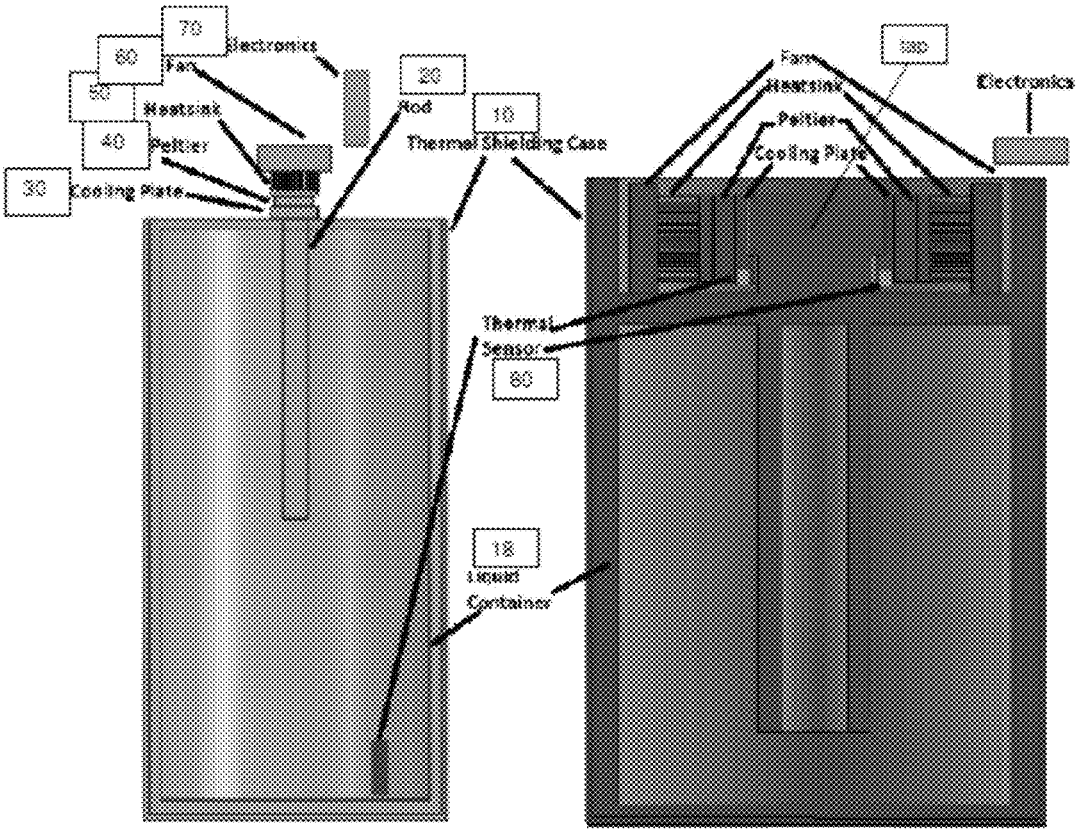
FIG. 3A is a schematic representation of a cut-away view of the liquid temperature controlling system shown in FIGS. 1A-1B that is fully assembled and in use in a liquid container, in accordance with an embodiment of the present invention.
FIG. 3B is a schematic representation of a cut-away view of the liquid temperature controlling system shown in FIGS. 2A-2B that is fully assembled and in use in a liquid container, in accordance with an embodiment of the present invention.

Turning to FIG. 3*a*, a schematic representation of a cutaway view of the liquid temperature controlling system 100 that is fully assembled and in use in a liquid container is shown, in accordance with an embodiment of the present invention.

Figures 2A, 2B:
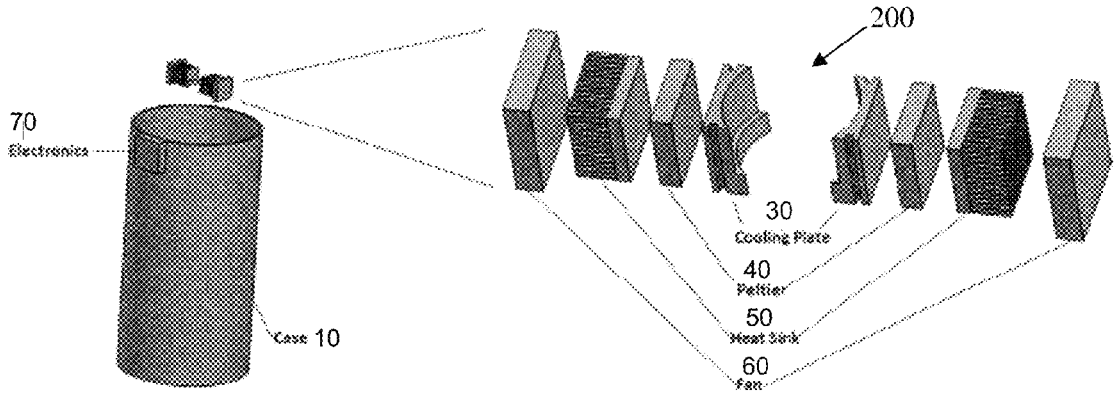
FIGS. 2A-2B are assembled and exploded schematic representations, respectively, of a liquid temperature controlling system in accordance with an alternative embodiment of the present invention.

Turning to FIG. 2*a-b*, a schematic representation of a liquid temperature controlling system 200 according to an alternative embodiment of the present invention is shown (2*a*—liquid temperature controlling system 200 with its component parts connected; 2*b*—liquid temperature controlling system 200 with its component parts in a semi-exploded view). FIG. 2*a-b* also shows a thermal shielding case 10 that surrounds a liquid container (not shown). Liquid temperature controlling system 200 includes, but is not limited to two cooling plates 30, two peltier/thermodynamic chips 40, two heat sinks 50, two fans 60, electronics 70, and a thermal sensor/temperature detection probe 80 (not shown). The two peltier/thermodynamic chips 40 are mounted to the top of the container (e.g., keg) which is preferably made out of a metal. The peltier/thermodynamic chips 40 are structured and/or configured to cool the contents of the entire vessel through the metal installation on which they are attached (in a similar manner as discussed with respect to FIG. 1 and the rod 20).

Thermally conductive silicon rubber can be used between a cooling plate 30/mount (not shown) and the object that conducts the temperature gradient in the liquid; this object can be, but does not have to be, a rod as described and shown in FIG. 1. For use on a keg, the temperature gradient can be conducted with the keg tap, which goes all the way to the bottom, and obviates the need for a separate rod 20 (see also FIG. 3*b*).

FIG. 2 is essentially a modular version of the liquid temperature controlling system 100 shown in FIG. 1 (the parts as shown can be included and used as necessary). In addition to being used to cool beer, for example, via a rod 20 as shown in FIG. 1, liquid temperature controlling system 200 can also cool a closed keg through attachment at the top of the keg (without use of the rod). Like liquid temperature controlling system 100, liquid temperature controlling system 200 can have an aerogel insulation 10 (or any other alternative thermally non-conducting material, e.g., Styrofoam) surrounding the liquid container to control the heat transfer from the liquid container. Liquid temperature controlling system 200 can also use thermoelectric chips 40 for cooling and/or heating, the heat or cold from which will still be removed with heat sinks 50 (as shown).

Liquid temperature controlling system 200 can differ from Liquid temperature controlling system 100 in the structure of its thermoelectric chips 40. Two or more thermoelectric chips 40 can be used in liquid temperature controlling system 200 (as shown). Each chip 40 can have its own heat sink 50 attached to it with glue or thermal paste, for example. Instead of being attached to a centralized plate, each chip 40 can be attached to a custom-made mount (here, the uniquely designed cooling plate that surrounds the tap) that can be form fitting to the liquid container (which can attach to the liquid container/tap with preferably no gaps between the cooling plate and the liquid container/tap). The custom mount can have the thermally conductive silicon rubber attached to its surface. The mounts can be housed in a plastic shell that keeps them in a specific orientation to each other. The shell can be attached to the spout of the keg. The thermoelectric chips 40 can be structured/configured to cool and/or the tap of the keg, which is submerged in the keg. The temperature feedback loop is similar to liquid temperature controlling system 100 except that, instead of a submerged temperature probe, there is a thermo couple or thermo sensor or multiple sensors 80 that are actually touching the keg (whether on the spout, top, or sides) making sure that it stays at the determined temperature (see FIG. 3*b*).

Turning to FIG. 3*b*, a schematic representation of a cutaway view of the liquid temperature controlling system 200 that is fully assembled and in use in a liquid container is shown, in accordance with an embodiment of the present invention.

In another alternative embodiment, instead of the cooling and/or heating occurring at the top/spout, cooling and/or heating can happen through pieces (devices that use the peltier effect) installed in the actual jacket, thermal shielding case, and/or liquid container. Instead of cooling and/or heating going through a submerged portion (e.g., rod or spout) it could go through the surrounding apparatus.

Figure 5:
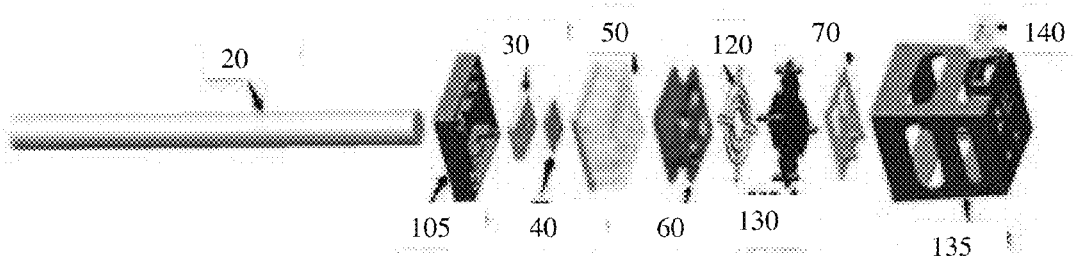
FIG. 5 is an exploded schematic representation of a liquid temperature controlling system in accordance with an alternative embodiment of the present invention.

Turning to FIG. 5, an exploded schematic representation of a liquid temperature controlling system in accordance with an alternative embodiment of the present invention is shown. The liquid temperature controlling system shown in FIG. 5 includes, but is not limited to, an immersion rod 20, a mounting base 105, an adapter (or cooling) plate 30, a TE element (or peltier chip) 40, a heat sink 50, a fan 60, a fan guard 120, a PCB mount cover 130, a PCB (or controller) 70, a top cover 135, and a RTD plug 140.

Figure 6:
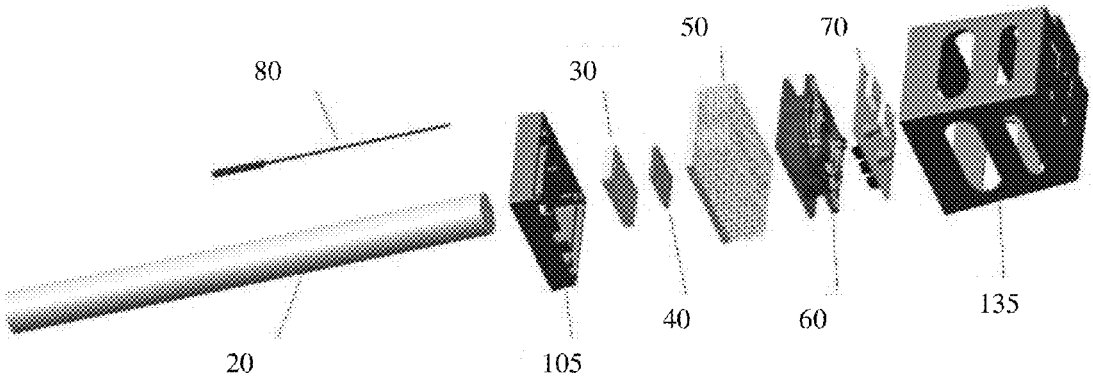
FIG. 6 is an exploded schematic representation of a liquid temperature controlling system in accordance with an alternative embodiment of the present invention.

FIG. 6 is similar to FIG. 5, and adds in thermal sensor 80.

Figure 7:
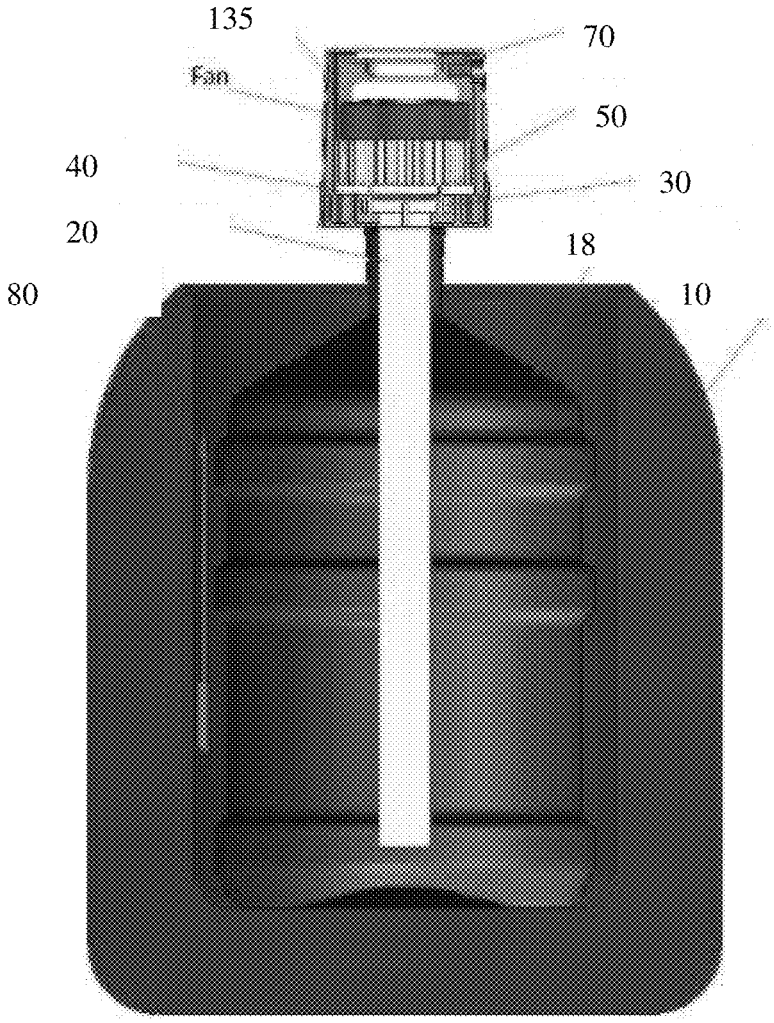
FIG. 7 is a schematic representation of an assembled liquid temperature controlling system in accordance with an alternative embodiment of the present invention as shown in FIG. 6.

FIG. 7 is a schematic representation of an assembled liquid temperature controlling system in accordance with an alternative embodiment of the present invention as shown in FIG. 6.

While several embodiments of the invention have been discussed, it will be appreciated by those skilled in the art that various modifications and variations of the present invention are possible. Such modifications do not depart from the spirit and scope of the present invention.

What is claimed is:

1. A modular liquid temperature controlling system for controlling the temperature of a liquid within a container, the system comprising:

at least one metal rod structured to contact and be submerged in liquid in the container and configured to increase or decrease the temperature of a portion of the liquid contacting said at least one metal rod by conduction; and at least one thermoelectric peltier chip connected to said at least one metal rod;

a thermal sensor structured to contact or be submerged in liquid in the container and configured to detect a first temperature of the liquid; and an electronic control device connected to said thermal sensor and connected to said at least one thermoelectric peltier chip, wherein said electronic control device is configured to:

increase the temperature of the liquid to a second temperature which is higher than said first temperature by increasing the temperature of said at least one metal rod through control of a current in a first direction through said at least one thermoelectric peltier chip; and decrease the temperature of the liquid to a third temperature which is lower than said first temperature by decreasing the temperature of said at least one metal rod through control of a current in a second direction through said at least one thermoelectric peltier chip.

2. The system of claim 1, further comprising at least one cooling plate connected to said rod and to said at least one thermoelectric peltier chip.

3. The system of claim 2, further comprising at least one heat sink connected to said at least one thermoelectric peltier chip.

4. The system of claim 3, further comprising a fan connected to said at least one heat sink.

5. The system of claim 1, wherein said at least one rod is made from a metal comprising a metal selected from the group consisting of stainless steel, plated aluminum, aluminum, steel, copper, nickel, titanium, and iron.

6. The system of claim 5, wherein said at least one rod is anodized.

* * * * *